US008218805B2

(12) United States Patent
Hornback

(10) Patent No.: US 8,218,805 B2
(45) Date of Patent: Jul. 10, 2012

(54) WIRELESS SPEAKER SYSTEM FOR USE WITH CEILING FANS

(76) Inventor: Charles Hornback, University Park, FL (US)

( * ) Notice: Subject to any disclaimer, the term of this patent is extended or adjusted under 35 U.S.C. 154(b) by 1197 days.

(21) Appl. No.: 12/012,254

(22) Filed: Jan. 31, 2008

(65) Prior Publication Data

US 2008/0181426 A1 Jul. 31, 2008

Related U.S. Application Data

(63) Continuation-in-part of application No. 10/928,695, filed on Aug. 26, 2004, now abandoned.

(60) Provisional application No. 60/510,745, filed on Oct. 11, 2003.

(51) Int. Cl.
*H04R 1/02* (2006.01)
*H04R 9/06* (2006.01)

(52) U.S. Cl. ..... 381/333; 381/388; 381/87; 381/124; 455/3.06; D23/385

(58) Field of Classification Search ..... 381/77, 381/79, 332, 333, 334, 386, 388, 99, 300, 381/301, 87, 124; 455/3.06, 41.3; 392/360, 392/364; D23/370, 377, 385, 411
See application file for complete search history.

(56) References Cited

U.S. PATENT DOCUMENTS

| | | | | |
|---|---|---|---|---|
| 3,165,587 | A | 1/1965 | Alderson | |
| 3,927,316 | A | 12/1975 | Citta | |
| 4,371,814 | A | 2/1983 | Hannas | |
| 4,528,620 | A | 7/1985 | Weber | |
| 5,410,735 | A | 4/1995 | Borchardt et al. | |
| 5,980,057 | A | 11/1999 | Christie | |
| 6,215,885 | B1 | 4/2001 | Geiger | |
| 6,466,832 | B1 | 10/2002 | Zuqert et al. | |
| 6,577,081 | B2 | 6/2003 | Dickie | |
| 6,580,228 | B1 | 6/2003 | Chen et al. | |
| 6,731,761 | B1 | 5/2004 | Zablocki et al. | |
| 7,076,204 | B2 | 7/2006 | Richenstein et al. | |
| 7,606,379 | B2 * | 10/2009 | Ivey et al. | 381/160 |
| 7,844,060 | B2 * | 11/2010 | Zulkowski | 381/87 |
| 7,862,371 | B1 * | 1/2011 | Johnson | 439/530 |

FOREIGN PATENT DOCUMENTS

JP 61065092 A 4/1986

OTHER PUBLICATIONS

English Translation of JP 61065092|A to Yuzo, Apr. 3, 1986.

* cited by examiner

*Primary Examiner* — Xu Mei
(74) *Attorney, Agent, or Firm* — Gifford, Krass, Sprinkle, Anderson & Citkowski, P.C.

(57) ABSTRACT

A multi-channel wireless speaker system to be used with ceiling fans wherein the audio source generator can be one of many medias, not limited by the following: television, stereophonic, monophonic, video game, home theater, public address system or security system. The audio source generator sends an audio signal to the transmitter that in turn relays the audio signal to the wireless receiver located in the ceiling fan housing member. The ceiling fan housing member includes speakers, and a light source if desired. The speakers produce an omni directional sound due to their unique positioning within the ceiling fan. The wireless speaker system is powered by the existing voltage available to the ceiling fan, so no new wiring is required to install the speaker system. The speaker settings are manipulated via a remote control.

17 Claims, 15 Drawing Sheets

WIRELESS SPEAKER SYSTEM FOR USE WITH CEILING FANS

This application is a Continuation-In-Part of U.S. patent application Ser. No. 10/928,695, filed on Aug. 26, 2004 now abandoned, which was published as U.S. Patent Application Publication No. US2005/0078837 on Apr. 14, 2005, which claims the benefit of U.S. Provisional Application No. 60/510,745, filed Oct. 11, 2003.

INTRODUCTION

This invention relates to a wireless speaker system configured for use with ceiling fans. The invention facilitates the ability to listen or play centrally-located sound without the need for a stand or table.

BACKGROUND OF THE INVENTION

Generally, audio speaker systems are maintained within their own physical housing, although, in recent years the popularity of placing speakers within other household structures and electronics has risen. The purpose of such a combination is to combine the functions of cooling and audio systems in one decorative, space saving location. Wireless transmission, particularly at or around 900 MHz, has enabled audio wireless systems to be used in conjunction with many household fixtures.

Problems in the prior art include the need to have separate mountings for speakers and ceiling fans, to have additional wiring for speakers and ceiling fans, to have separate types of speakers for varying types of signal inputs, to have conspicuous visible speakers, to have the desired location for speakers on a ceiling already occupied by a ceiling fan, among others, all of which aim to be addressed by the present invention. Additional problems in the prior art, particularly in the combination of speakers with other items, include poor sound quality, poor sound distribution, overheating, difficulty in installation, incompatibility between the speaker and the item, and other problems known by those of ordinary skill in the art.

SUMMARY OF THE INVENTION

The wireless speaker system of the present invention is constructed in a manner wherein a ceiling fan housing member can support the speakers and receiver of said speaker system. The purpose of such a combination is to centralize audio entertainment within a common household fixture, in this case a ceiling fan. The integrated wireless speaker system/ceiling fan also provides a space-saving mechanism by removing the need for speaker stands or tables. The wireless speaker system for ceiling fans includes an audio source generator, a transmitter, a receiver, an amplifier, speakers and a ceiling fan. The speakers may be controlled via a remote control. Another additional feature of the invention is that the power provided to the bottom of the ceiling fan also powers the wireless speaker system so that no new wiring is required to install the speaker system into an existing ceiling fan.

DETAILED DESCRIPTION OF THE PREFERRED EMBODIMENTS

As shown in the accompanying figures, the present invention relates to a wireless speaker system 1 used in combination with a ceiling fan.

Figure 1:
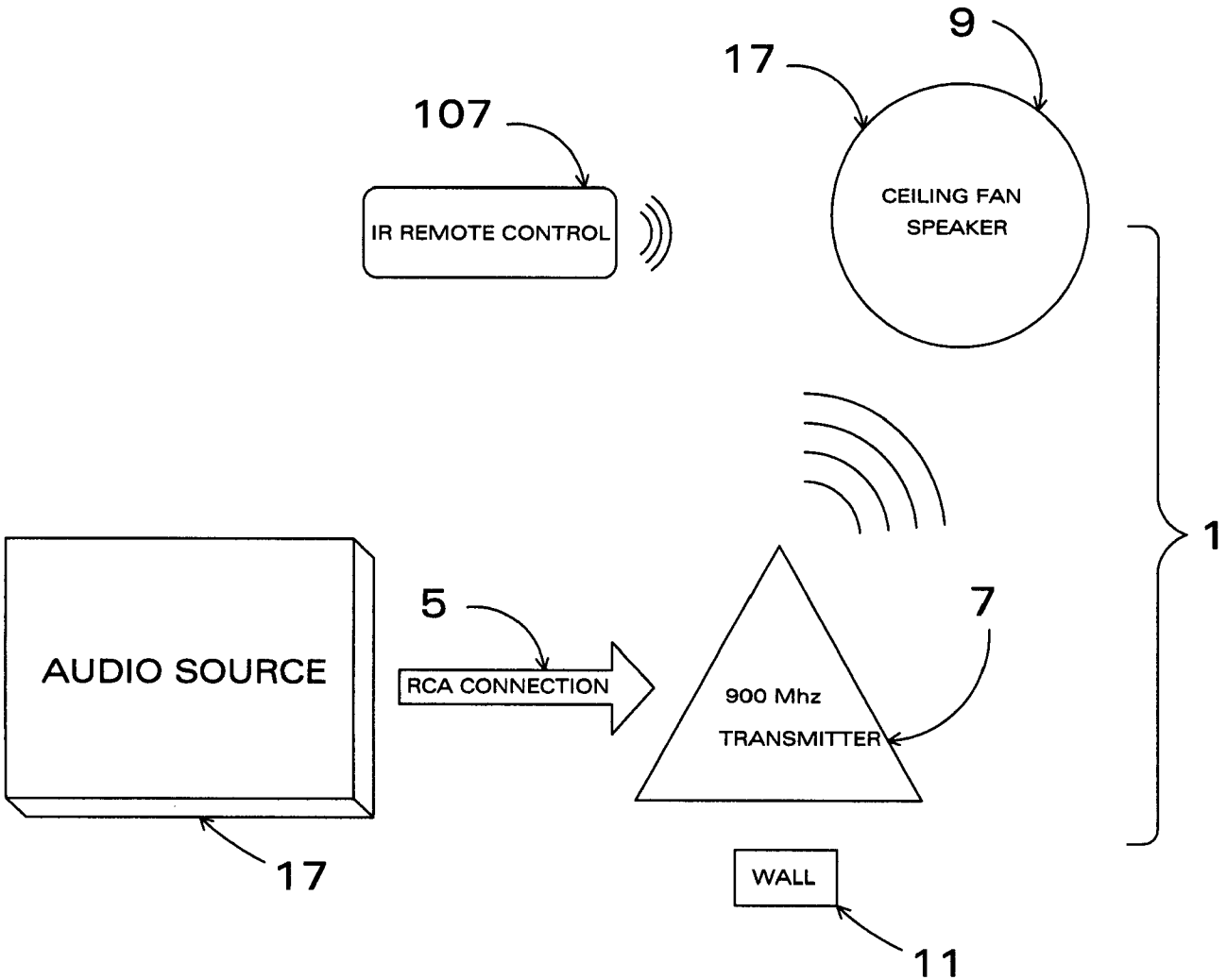
FIG. 1 is a generalized view of the wireless speaker system components and how they are connected.

Referring to FIG. 1, the wireless speaker system 1 includes an audio source generator 3, RCA (The Radio Corporation of America) connectors 5, an audio input cord 99 (not shown in FIG. 1), a transmitter 7 mounted to a wall 11, speakers 17, a wireless receiver 9 and a remote control 107. It should be noted that "RCA" is a registered trademark of General Electric Company.

Figure 5A:
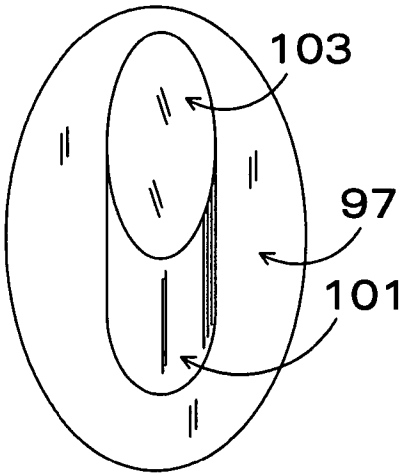
FIG. 5A is a frontal view of one embodiment of the transmitter.
Figure 5C:
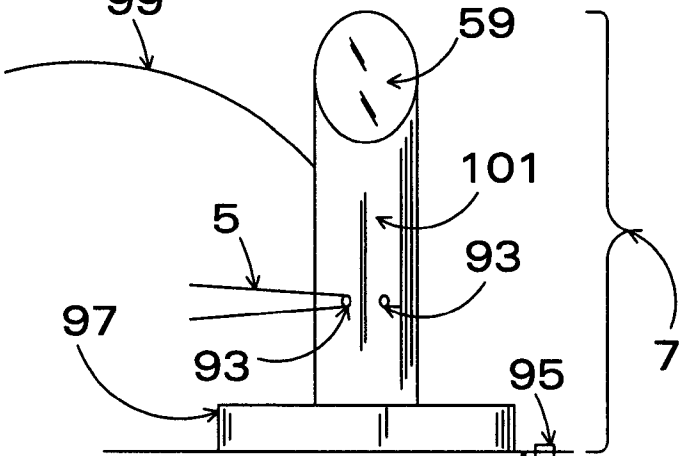
FIG. 5C is a top view of one embodiment of the transmitter.
Figure 5B:
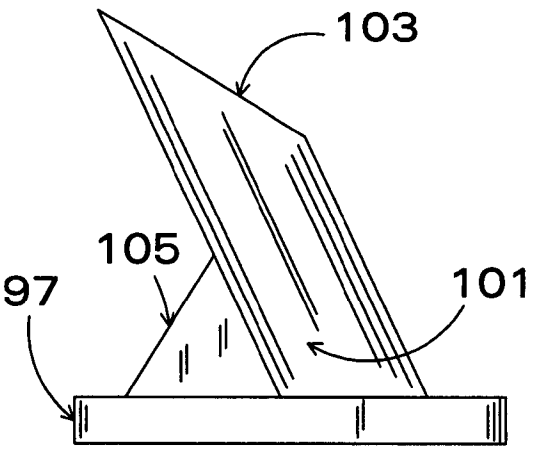
FIG. 5B is a side view of one embodiment of the transmitter.

Referring collectively to FIGS. 5A, 5B, and 5C, an embodiment of a transmitter 7 of the present invention is shown in detail. The transmitter 7 has a base 97, a stand 101 with a support block 105 and a top surface 103. The transmitter 7 has two inputs 93 for audio source generators 3 and a wall transformer power source 95. As shown in FIG. 1, RCA connectors 5 connect the audio source generator 3 and the transmitter 7. An audio input cord 99 also runs to the transmitter 7. In one embodiment, the transmitter 7 is located within the wall 11.

Figure 6A:
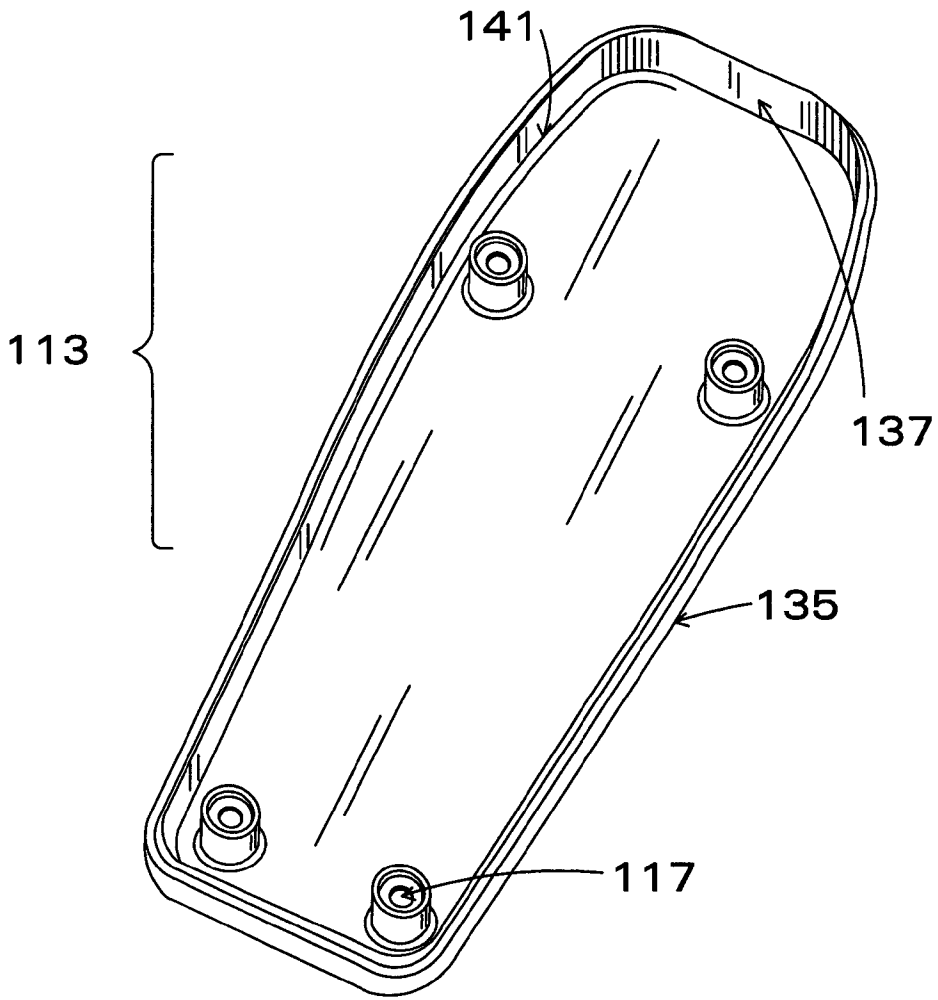
FIG. 6A is a view of the base of one embodiment of the remote control.
Figure 6B:
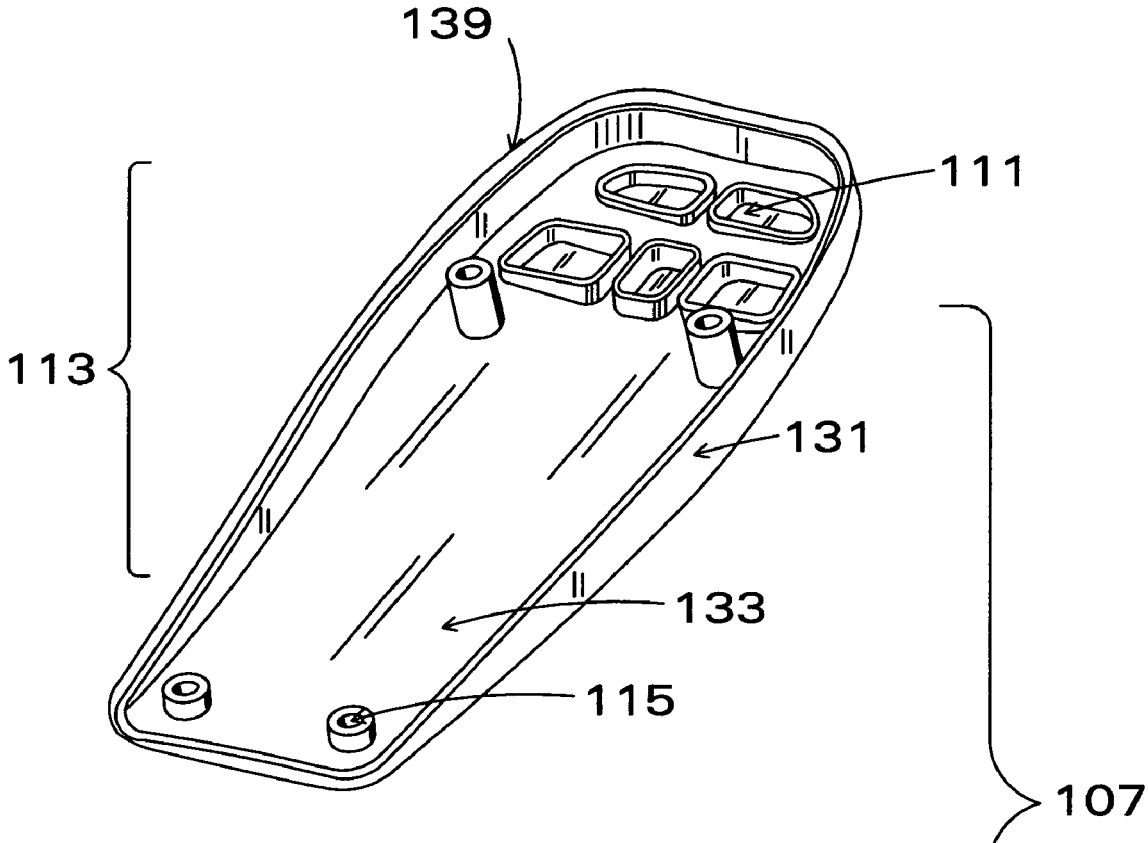
FIG. 6B is a view of the cover of one embodiment of the remote control
Figure 6C:
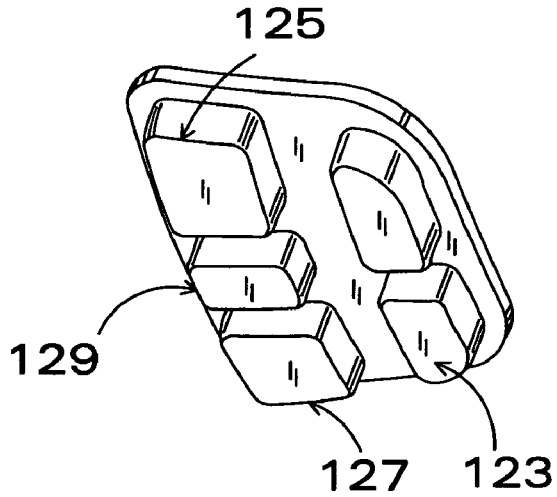
FIG. 6C is a view of the keypad of one embodiment of the remote control

Referring collectively to FIGS. 6A, 6B, and 6C, an embodiment of a remote control 107 of the present invention is shown in detail. Preferably, the wireless speaker system 1 can be operated via a remote control 107. The remote control 107 comprises a remote control top 109 with keypad openings 111 and a remote control bottom 113. The remote control top 111 and the remote control bottom 113 are connected with fasteners 115 via the fastener apertures 117, the fasteners being any suitable for connecting the remote control top 109 and the remote control bottom 113 known to those of ordinary skill in the art. The remote control top 109 has an outer surface 131 and an inner surface 133. The remote control bottom 113 also has an outer surface 135 and an inner surface 137. When the remote control top 109 and the remote control bottom 113 are attached via the fasteners 115, the top surface of the remote control top 139 and the top surface of the remote control bottom 141 meet so that there is no opening between the two. A keypad 119 may be present between the remote control top 109 and the remote control bottom 111. In a preferred embodiment, the remote control key pad 119 has five speaker control buttons: the speaker system on/off button 121, the light source on/off button 123, volume up 125, volume down 127 and the receiver channel 129. In an embodiment, the remote control 107 may able to turn the speaker system 1 on or off, the lights on or off, the volume of sound being produced from the speakers 17 up or down, change to channel of the receiver 9 to overcome any interference, or any combination thereof. In a preferred embodiment the remote control 107 operates via infrared transmission.

A first embodiment of an element of the present invention is detailed in FIGS. 2, 3, 4A, 4B and 4C, wherein the speaker 17 or speakers 17 of the present invention are directed downward from the ceiling, and away from the existing fan assembly 29.

Figure 2:
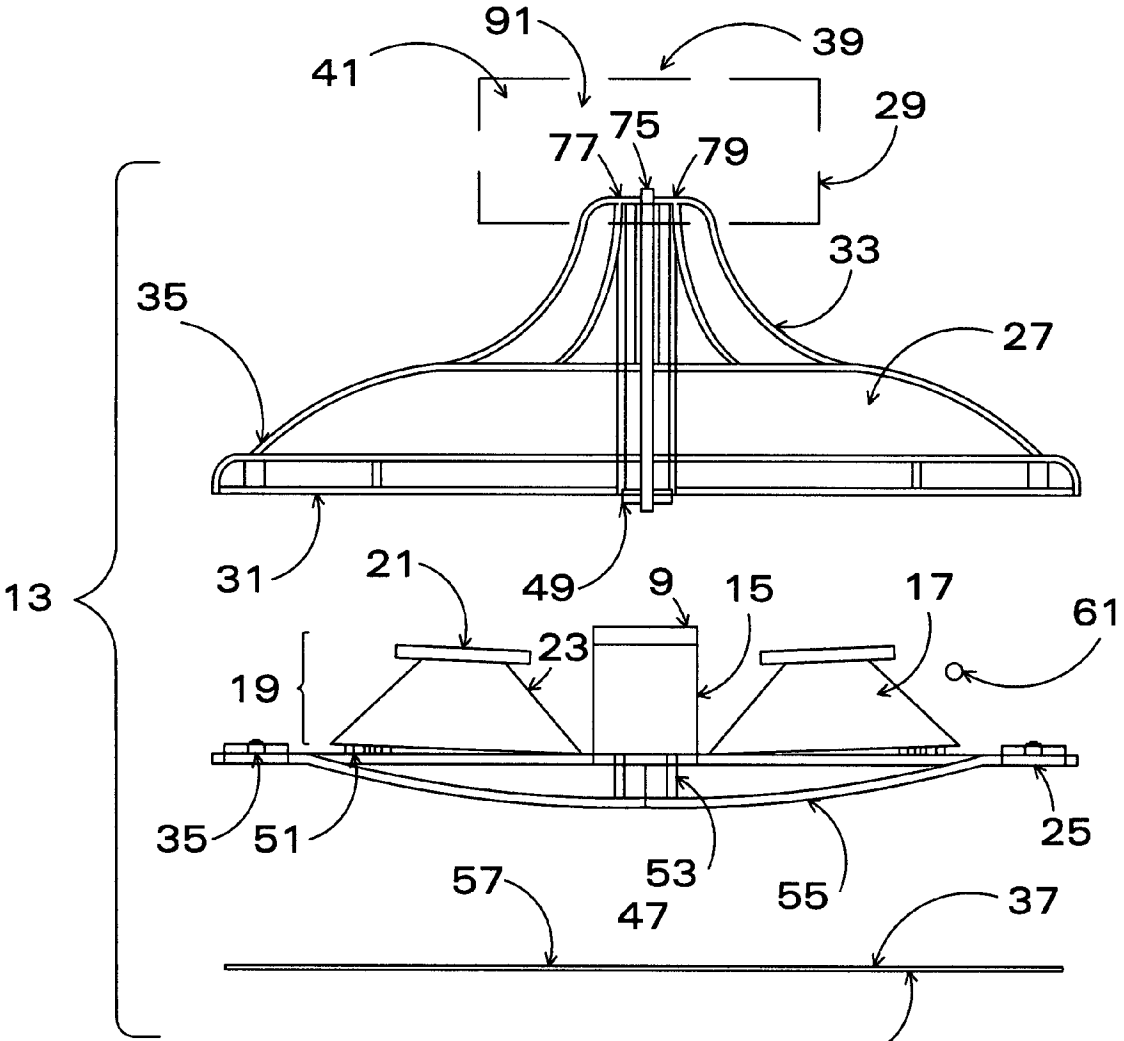
FIG. 2 is a frontal view of a first embodiment of the ceiling fan housing member and all of its components.
Figure 3:
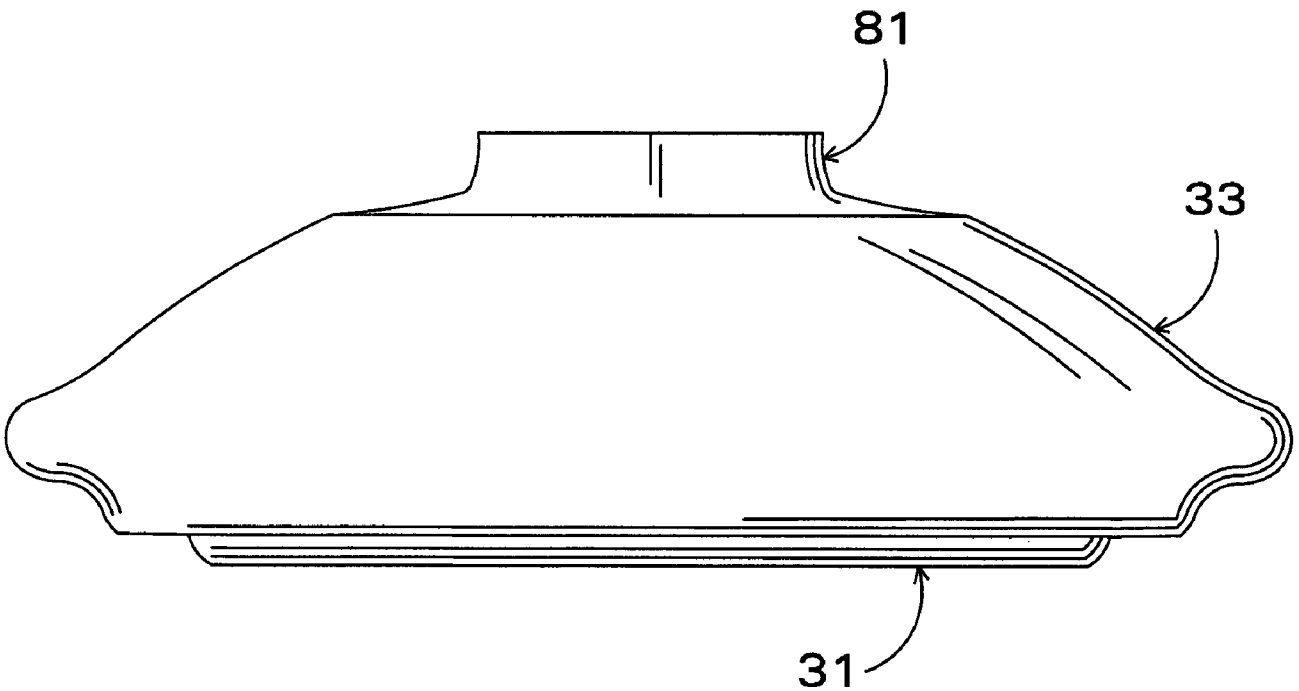
FIG. 3 is an elevation view of a first embodiment of the ceiling fan housing member.

Referring to FIG. 2, the wireless receiver (also referred to as "RF Receiver") 9 is located within the ceiling fan housing member 13. The audio source generator 3 and the transmitter 7 are located distal from the wireless receiver 9. The amplifier 15 and the speakers 17, are also located in the ceiling fan housing member 13. The speakers 17 are enclosed by a speaker housing member 19 that consists of an upper surface 21 and a lateral surface 23.

Referring to FIGS. 3, 4A, 4B and 4C, the speakers 17, in this first embodiment, consist of a bass speaker 63, a midrange speaker 65 and a tweeter 67. Each speaker 17 has a sound grid 89 located on the outer surface 90 of the respective speakers 17. The speakers may be virtually any suitable shape and size, the range of which is readily apparent to those of ordinary skill in the art, and may be dependent on the size of the ceiling fan housing member 13, the speaker housing member 19, or both. In a preferred embodiment, the speakers 17 are substantially circular and are about nine inches in diameter. In one embodiment, the speakers 17 range from between 2-32 ohms. In a preferred embodiment, the speakers 17 may range from 2-16 ohms.

Referring again to FIG. 2, the upper portion of the ceiling fan housing member 13, the globe 27, attaches directly to the existing fan assembly 29 through an aperture 75 in the globe 27. Two supporting rings, an inner ring 77 and an outer ring 79 reinforce the aperture 75. The globe 27 includes a bottom rim 31 and an outer surface 33. The connection 39 of the fan housing member 13 to the existing fan assembly 29 is shown in dotted lines on FIG. 2. The existing fan assembly 29 also contains a fan assembly motor 41.

Figure 4A:
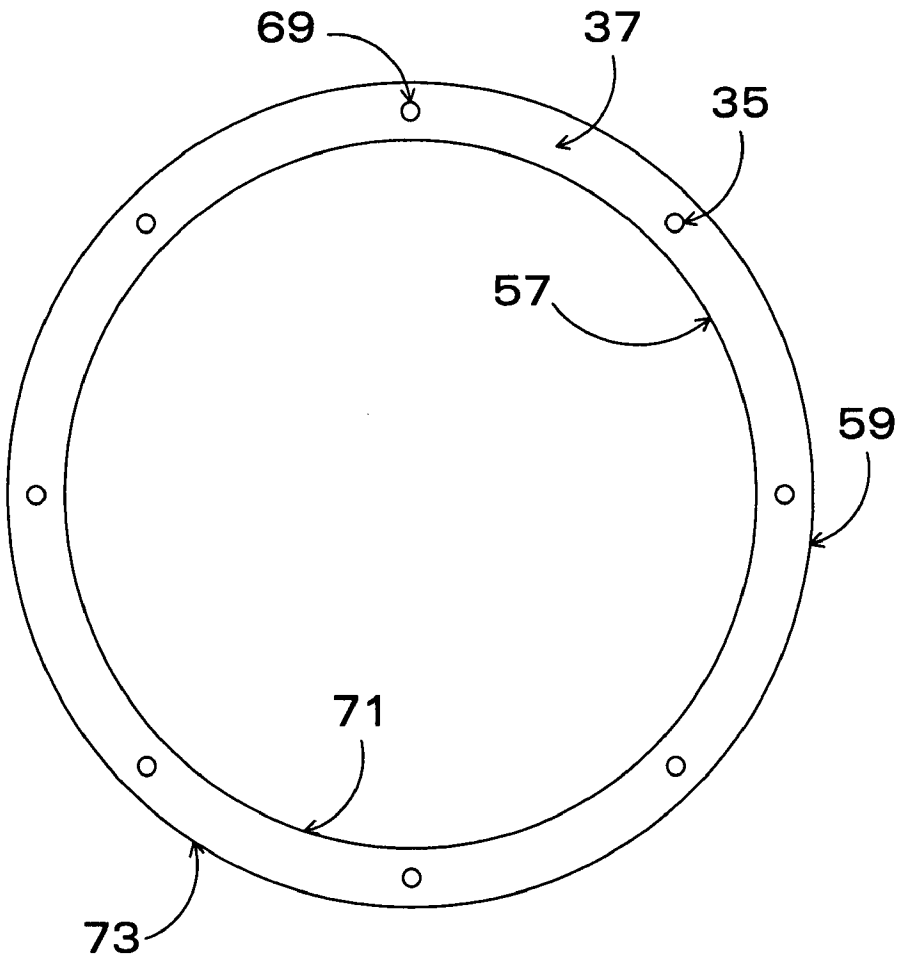
FIG. 4A is the first of a plan view series of a first embodiment of the ceiling fan housing member.
Figure 4B:
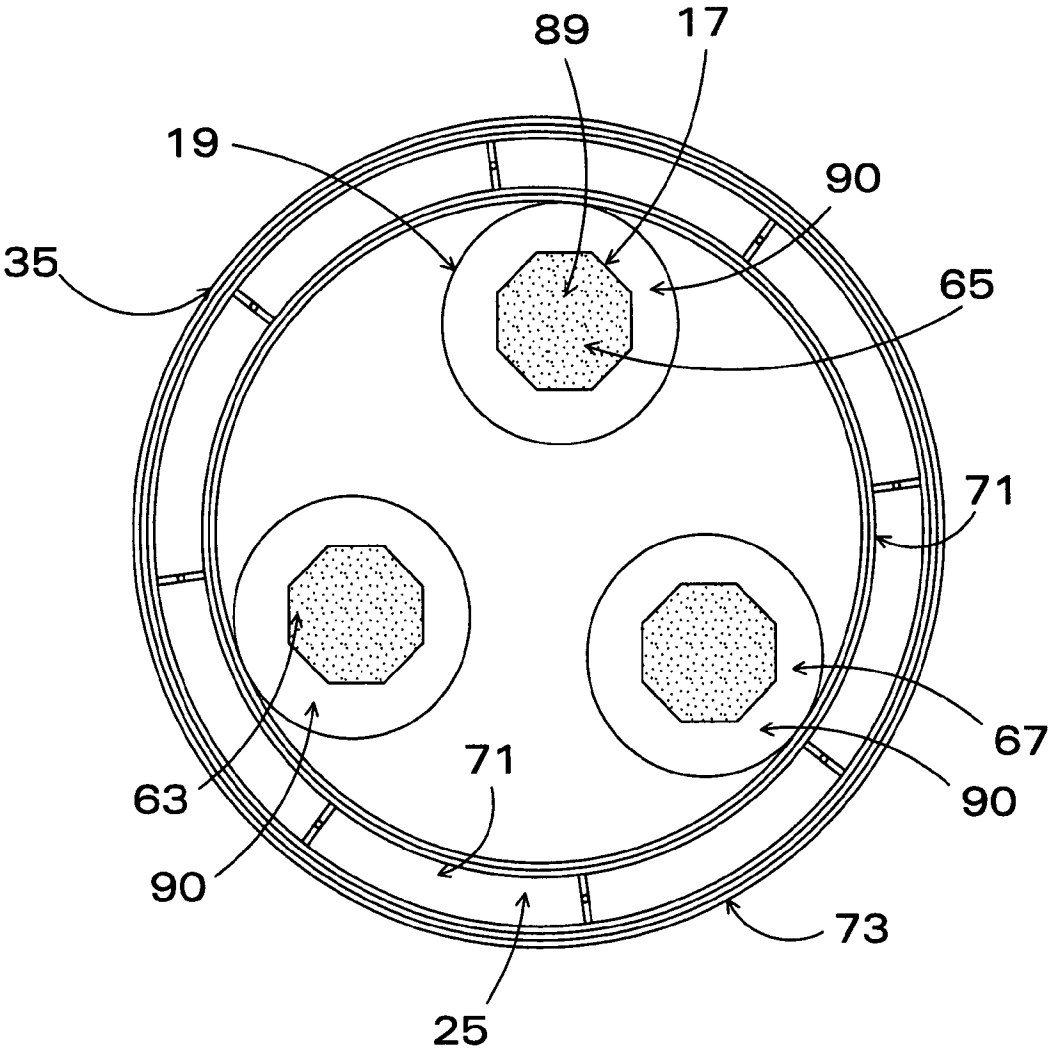
FIG. 4B is the second of a plan view series of a first embodiment of the ceiling fan housing member.
Figure 4C:
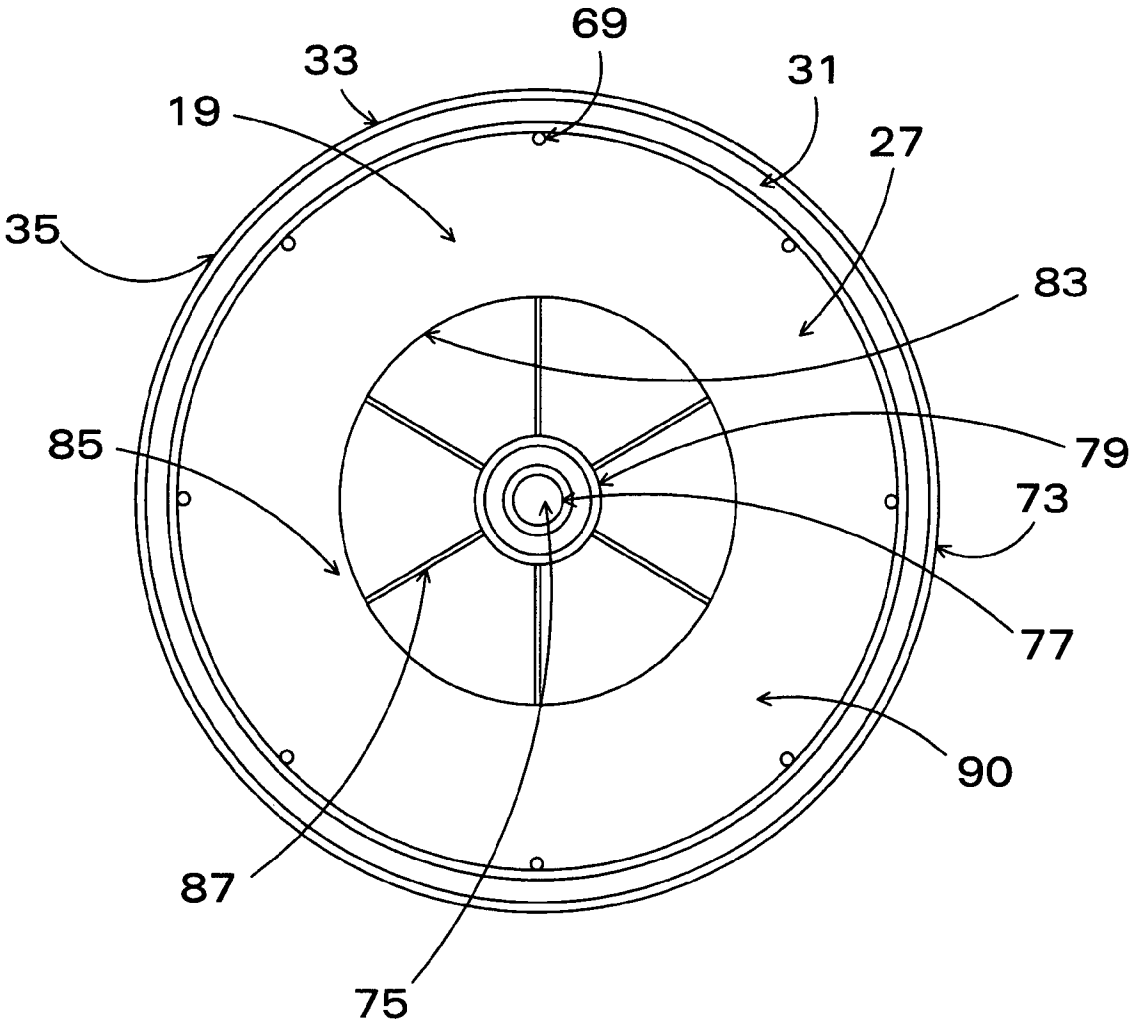
FIG. 4C is the third of a plan view series of a first embodiment of the ceiling fan housing member.

Referring to FIG. 4C, the bottom rim 31 of the globe 27 has an interior rim 71 and an exterior rim 73. The globe 27 also has an upper ring 81 that connects to the existing fan assembly 29. The upper ring 81 has an interior surface 83 and an outer surface 85. Spokes 87 are attached to the interior surface 83 of the upper ring 81 to provide support to the globe 27. Also housed within the globe 27 is the drive shaft 43. A drive shaft chamber 45 surrounds the drive shaft 43. Along the bottom rim 31 of the globe are fasteners 35 that connect the globe 27 to the lighting source 25 and the lens 37. The fasteners 35 connect the components by fastener openings 69.

Referring back to FIG. 2, the lower portion of the ceiling fan housing member 13, the lens 37, contains the speakers 17, wireless receiver 9 and amplifier 15 within an enclosed space 47. The lens 37 is connected to the globe 27 via a retaining nut 49. The speakers 17 are connected to the lighting source 25 via screws 51 and the receiver 9 and amplifier 15 are connected to the lighting source 25 via connectors 53. The light source 25 includes an illuminating bulb 55. The lens 37 has an inner surface 57 and an outer surface 59. The fan housing member 13 also contains a remote control input 61 (not shown).

A second embodiment of the present invention is detailed in FIGS. 7, 8, 9, 10, 11 and 12, wherein the speaker 17 or speakers 17 of the present invention are directed upwards toward the ceiling, and in the direction of the existing fan assembly 29. Besides this change in orientation of the speaker or speakers relative to the existing ceiling fan assembly, this second embodiment also includes additional components, and has an absence of some components of the first embodiment, as more fully illustrated in the Figures and described below. One particularly beneficial aspect to this second embodiment is the reduction of heat from the existing ceiling fan assembly 29 being introduced into the speaker 17, which improves performance, and is a distinguishing feature over the prior art.

Figure 7:
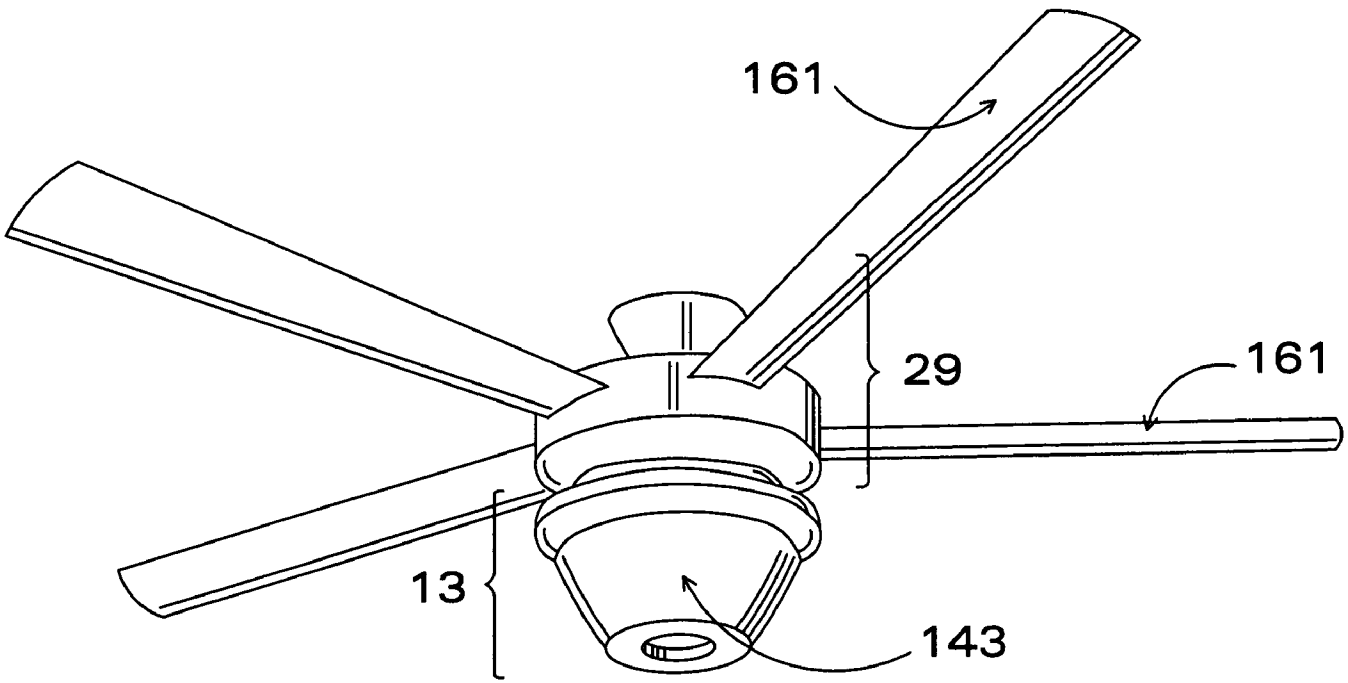
FIG. 7 is a below perspective view of a second fully assembled and mounted embodiment of the invention.
Figure 8:
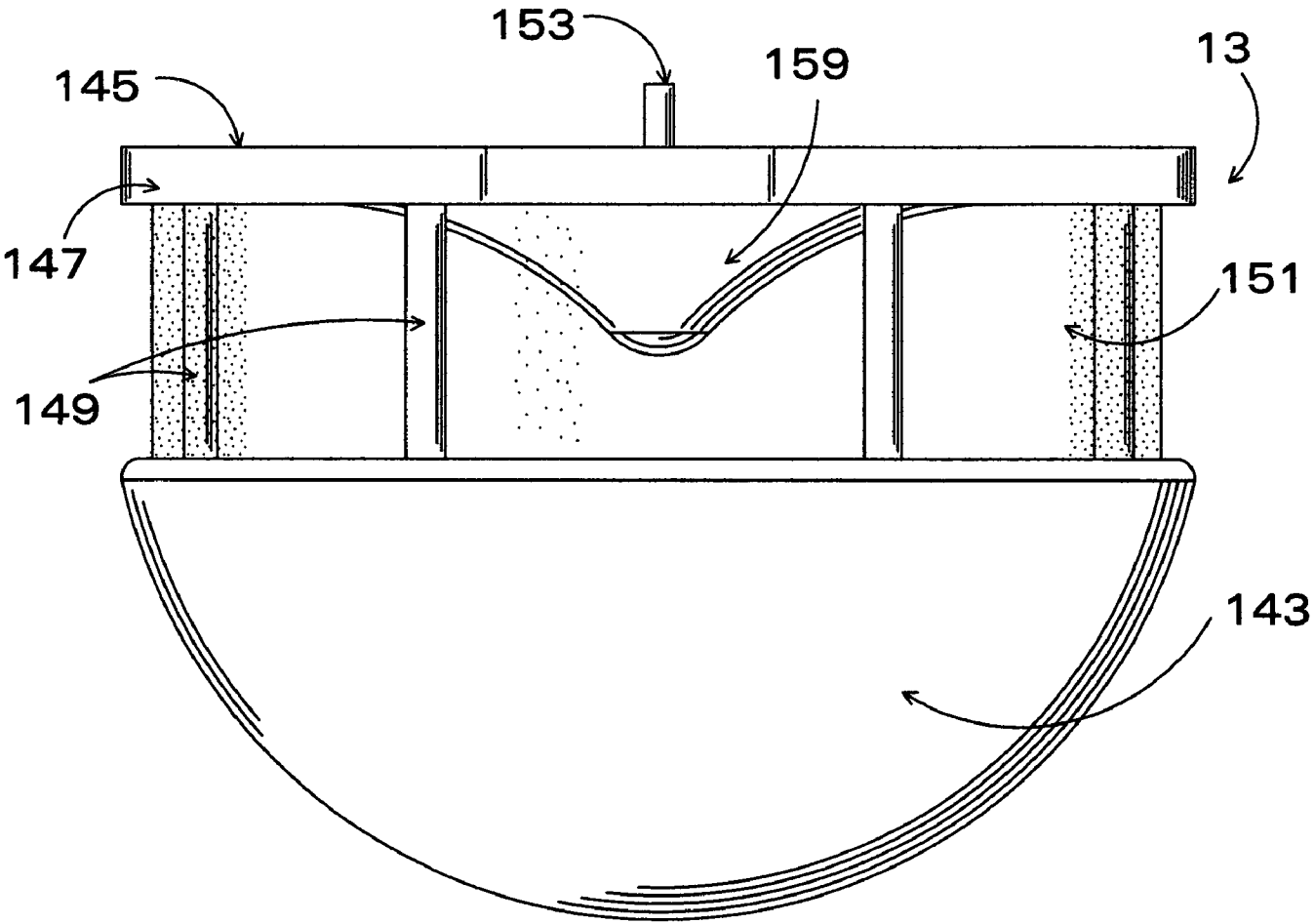
FIG. 8 is a side view of a second embodiment of the invention.
Figure 9:
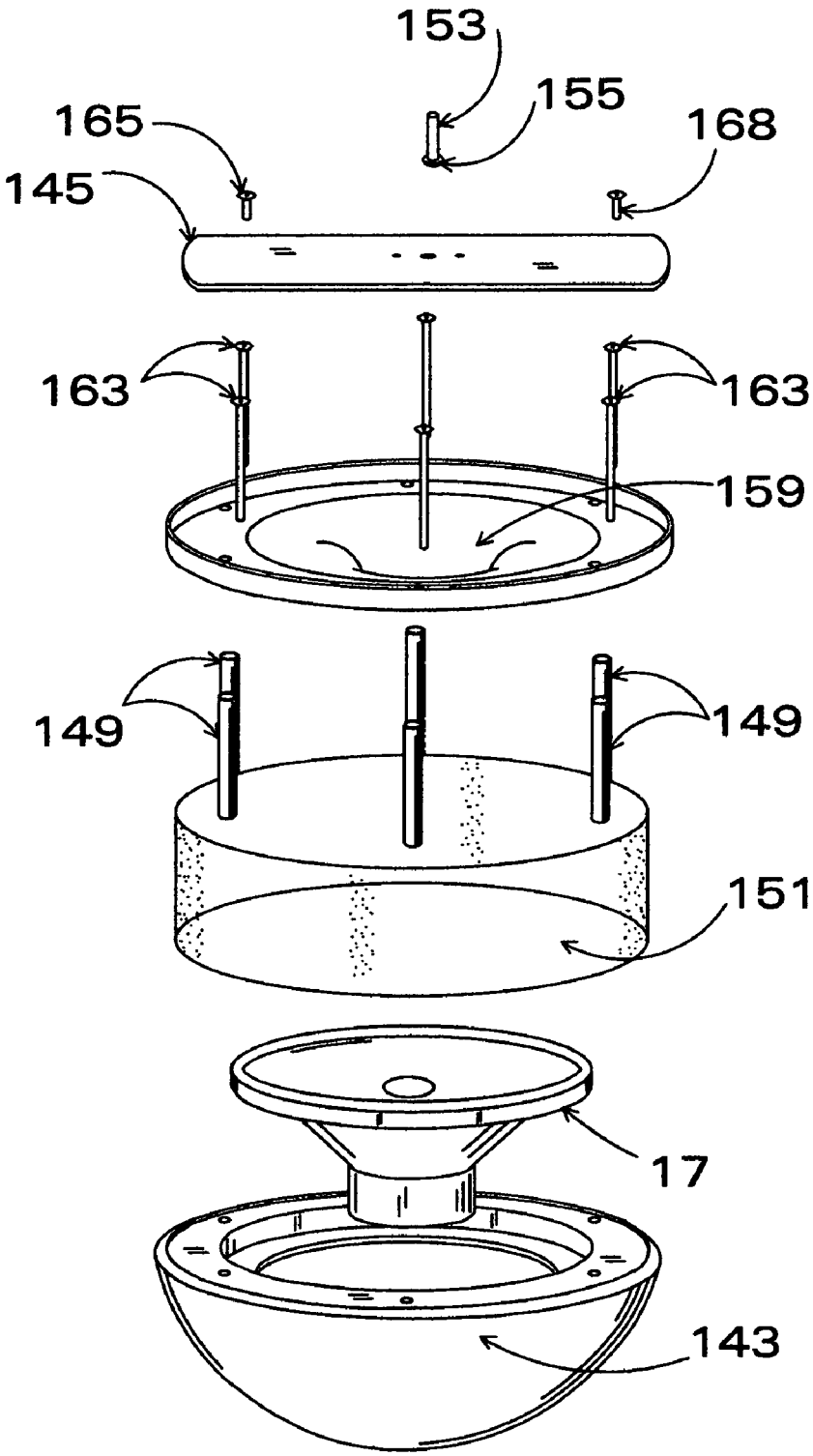
FIG. 9 is an exploded view of a second embodiment of the invention.
Figure 10:
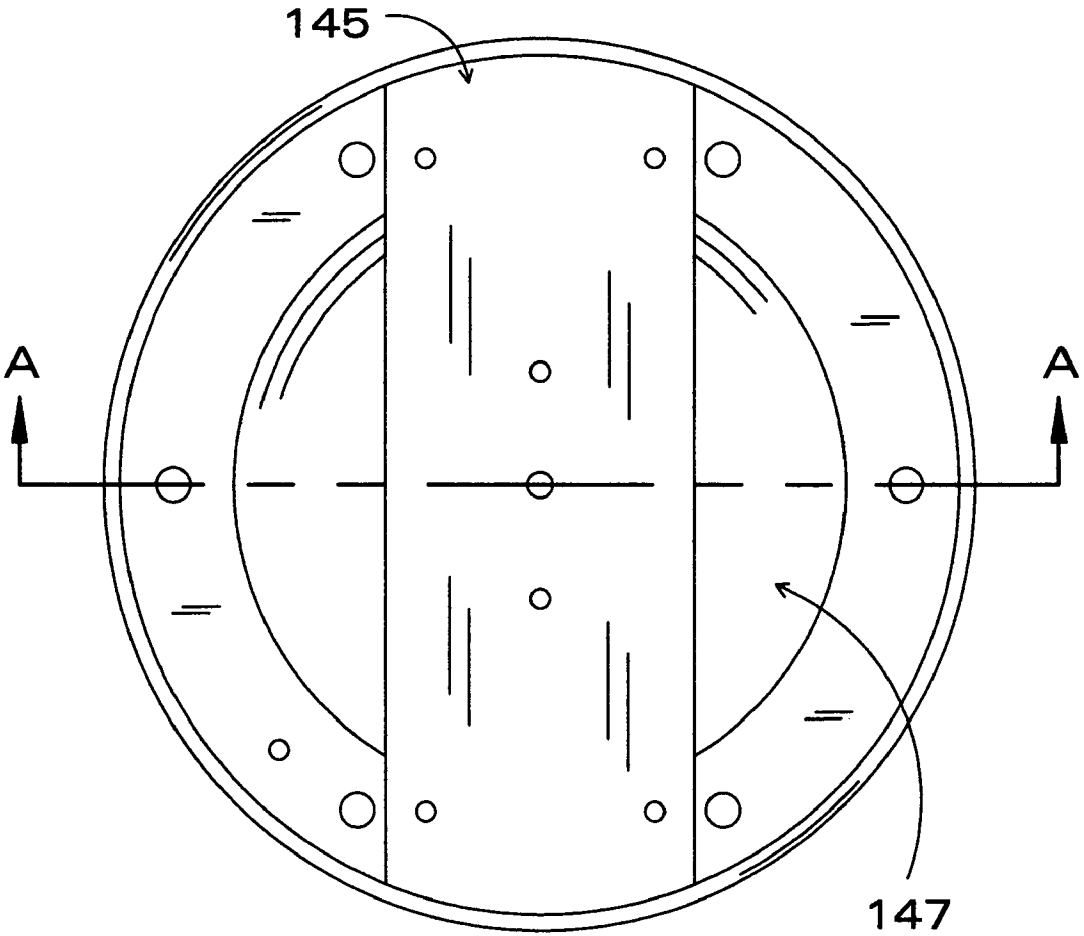
FIG. 10 is a top view of a second embodiment of the invention.
Figure 11:
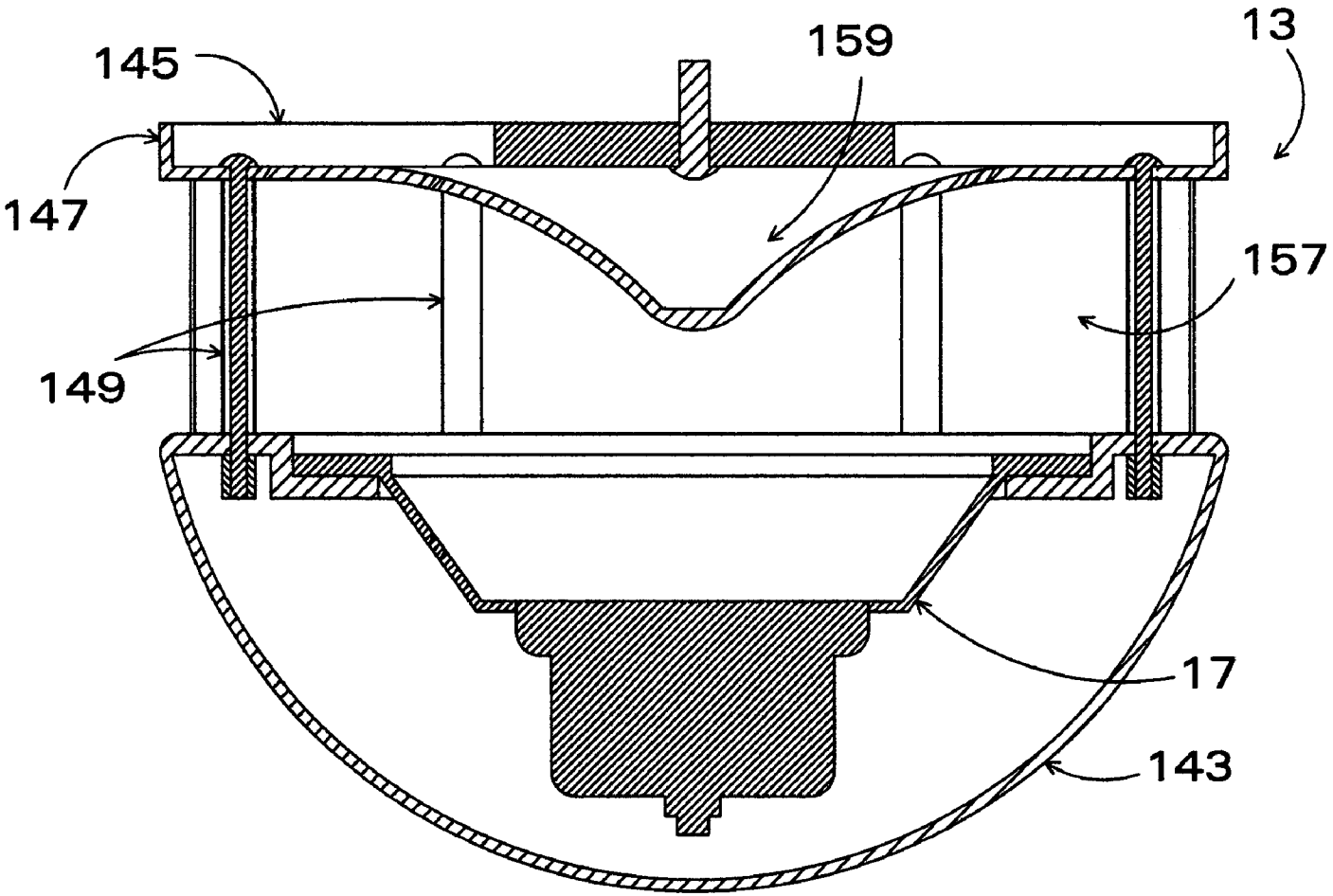
FIG. 11 is a cross section view, along line A-A, of a second embodiment of the invention.
Figure 12:
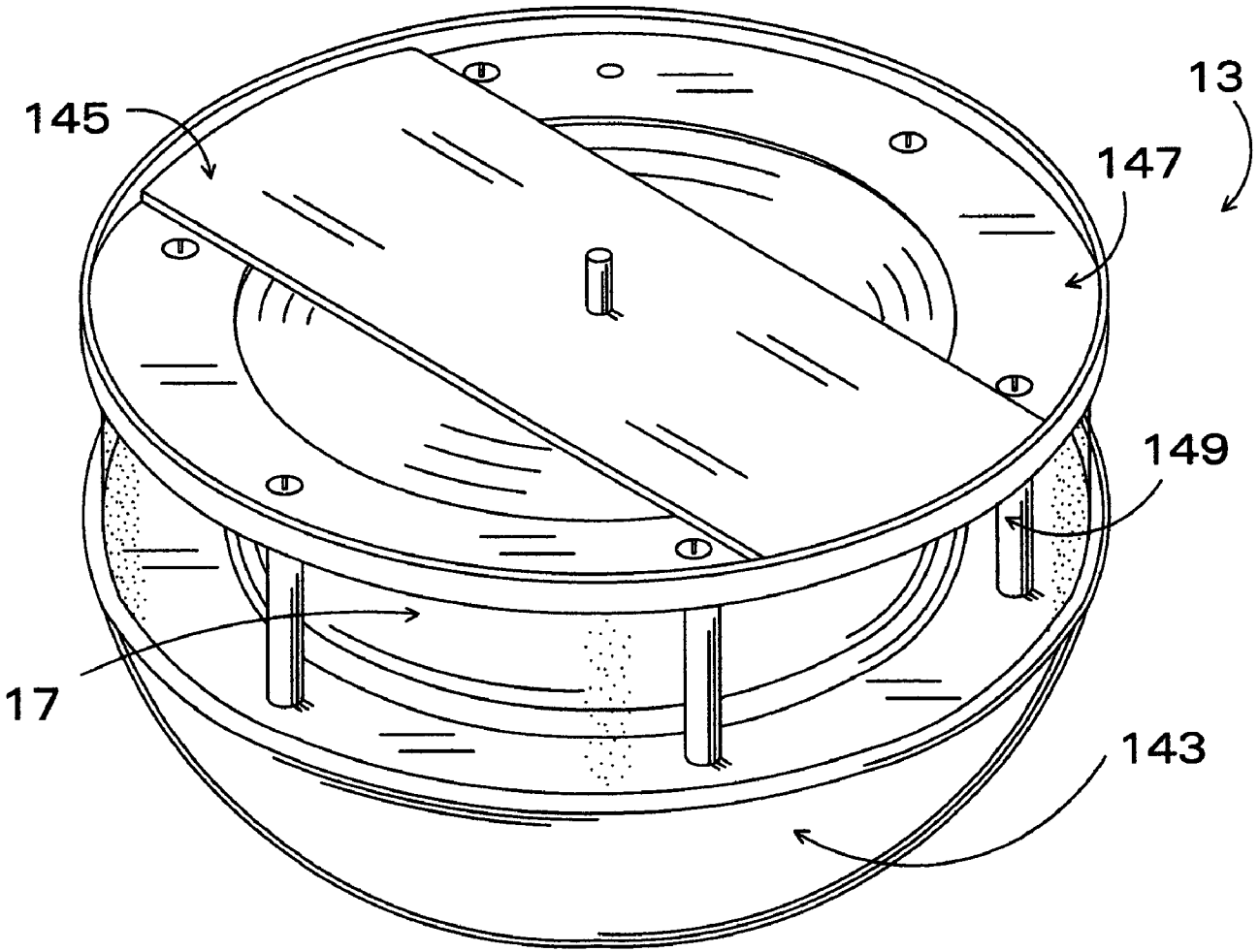
FIG. 12 is an isometric view of a second embodiment of the invention.

Referring to FIG. 7, a view from below of a fully assembled ceiling fan with the present invention installed thereon is visible. One particular design of this second embodiment is visible thereon, that being the speaker enclosure dome 143. The speaker enclosure dome houses the rear components of the speaker, and may optionally do so in an aesthetically pleasing manner. The receiver 9, amplifier 15, and remote control input 61 are among the components housed therein. The speaker enclosure dome 143 may be any suitable shape, but is preferably hemispherical or conical-frustral.

Referring to FIGS. 8, 9, 10, 11, and 12 collectively, several views of the ceiling fan housing member 13 of this second embodiment are visible. The globe 27 and the hardware associated therewith is not present in this second embodiment, and has been replaced by additional components, including a mounting bracket 145, an optional plate cover 147, one or more posts 149, and an optional screen 151. As can be seen in these Figures, which illustrate an embodiment where only one speaker is present, the speaker dome enclosure 143 is supported by the one or more posts 149, which hold the speaker dome enclosure onto the mounting bracket 145. It is preferred that a series of posts 149 are present to provide support to the speaker dome enclosure 143.

The mounting bracket 145 in turn supports the entire ceiling fan housing member 13 onto the existing ceiling fan assembly 29. The mounting bracket 145 may be fastened onto the existing ceiling fan assembly 29 by any suitable manner known by those of ordinary skill in the art, though this particular embodiment as illustrated includes a ⅜ inch threaded fastener 153, and a retaining nut 155, which is compatible with many ceiling fans currently in use and commerce. Screws 163 may be used to hold the speaker enclosure dome 143, the posts 149, the plate cover 147 and the sound displacement element 159 together, preferably passing through the posts 149, which when assembled comprises the ceiling fan housing member 13. Additional screws 165 may be used to hold the ceiling fan housing member 13 onto the mounting bracket 145.

A screen 151, when present, may cover the open space 157 between the speaker 17 or speakers 17 and the plate cover 147 and Mounting bracket 145. The screen may be made of any suitable material that permits the substantially unaltered transmission of sound from the speaker therethrough. Examples of types of screens include non-solid mesh screens, the mesh potentially substantially comprising fiber or metal or some combination thereof. The screen 151 both provides an aesthetically-pleasing appearance, disguises the presence of the post or posts 149 and other internal components of the present invention, and prevents the introduction of foreign debris onto the speaker 17.

A particularly important aspect of this second embodiment of the present invention is the presence of a sound displacement element 159, which may be in the form of a three-dimensional bell curve, as illustrated in the Figures. The sound displacement element therefore comprises a convex surface, possessing an infinite number of identical potentially bisecting lines through the site of greatest convexity of the sound displacement element. The site of greatest convexity of the sound displacement element is the lowest point of the sound displacement element, when it is horizontally installed, as seen in the Figures. The sound displacement element overcomes problems in the prior art relating to speakers being pointed in the direction of fans, including ceiling fans. Typically, when a speaker is aimed at a fan, the fan blades reflect a portion of the sound waves, while permitting some to pass through, resulting in a distortion of the sound. This problem is overcome through the use of the sound displacement element 159, in part because it prevents the ceiling fan blades 161 from interfering with the sound waves.

As can be seen in the Figures, the sound displacement element 159 should be centralized horizontally within the ceiling fan housing member 13, and directly over the center of the speaker 17. This is critical for proper dispersal of sound from the speaker 17, and to prevent sound interference from the rotating ceiling fan blades 161. The sound displacement element 159 constitutes a significant improvement over the art, and enables the speaker 17 to be pointed upward, which in turn prevents heat from the wiring and other components of the existing ceiling fan assembly 29 from interfering with the speaker 17. The additional electrical components of the ceiling fan housing member 13 of the present invention, such as the receiver 9 and the amplifier 15, may all be housed in the speaker enclosure dome 143 or in the concave cavity of the sound displacement element 159, on the side opposite the speaker 17.

In an embodiment, the speaker 17 or speakers 17 are, upon installation of the ceiling fan housing member 13, oriented so as to direct the greatest amount of sound at the site of greatest convexity of the sound displacement element 159.

In an embodiment, the center of the speaker 17 or speakers 17 is, upon installation of the ceiling fan housing member 13, oriented substantially directly underneath the site of greatest convexity of the sound displacement element 159.

In the present invention, with the presence of the sound displacement element 159, where more than one speaker 17 is present, it is important that those speakers be stacked, so that each may benefit from the presence of the sound displacement element. When so stacked, the center of each speaker 17 should be in line with the center of the sound displacement element 159. The order in which the speakers are stacked may be any.

A plate cover 147, when present, may provide additional structural support to the ceiling fan housing member 13, and may keep debris out of the concave portion of the sound displacement element 159.

This second embodiment, as a part of the speaker enclosure dome 143, may include an illuminating bulb 55 and additional light source components, as detailed elsewhere herein. It is preferred that the lens 37 covering the light source 25 be complimentary in shape to the outer surface of the speaker enclosure dome 143.

In an embodiment, the wireless speaker system 1 is simply installed in an existing ceiling fan. As shown in FIG. 2, the existing ceiling fan may contain a light source 25. In another embodiment, the wireless speaker system 1 is installed in a new ceiling fan. Also illustrated in FIG. 2, the wireless speaker system 1 may contain a light source 25 within the ceiling fan housing member 13. In another preferred embodiment, the light source 25 is white LED lighting, which is beneficial due to its negligible heat radiation on the speakers 17.

In operation, the audio source generator 3 produces an audio signal that is imputed via the RCA connectors 5 and an audio input cord to the transmitter 7. The audio signal can be produced by a number of various audio source generators 3. In one embodiment, the wireless speaker system 1 is multi-channel, meaning that the audio is selectable from more than one source. The audio source generator 3 can be any audio source provider, not to be limited by the following: television; stereophonic; amplifier; monophonic; video game; home theater; or a public address system.

In an embodiment, channels may be changed remotely, without the need to manually access the ceiling fan housing member 13, which is an improvement over the art. A dip switch, which is a form of spring-loaded click switch that breaks an electrical circuit, and is known by those of ordinary skill in the art, is a preferred component of the present invention, in conjunction with changing channels, in the event interference is encountered in the signal between the transmitter 7 and receiver 9. When present, a dip switch may be located in the transmitter 7, the receiver 9, the remote control 107 or more than one of those. In a preferred embodiment, the dip switch is located in the transmitter 7 and controlled by the remote control 107.

The transmitter 7 (FIG. 1) modulates the audio signal to a radio frequency and then transmits the audio signal wirelessly to a wireless receiver located in the ceiling fan housing member 13 (FIG. 2). The wireless receiver 9 then demodulates the audio signal. Then, as depicted in FIG. 2, the amplifier 15 amplifies the audio sound portion of the audio signal. The amplified sound portion is then sent to the speakers 17. The audio waves then travel through the sound grids 89 (FIG. 3) of each speaker 17 out to the listening audience.

The wireless speaker system 1 is powered by the existing voltage available at the bottom of the ceiling fan also known as the input power 91 (FIG. 2). The transformer 95 (FIG. 4) converts the input power 91, 110 VAC, to a lower DC voltage. The DC voltage powers both the receiver 9 and the amplifier 15 (FIG. 2), which in turn powers the speakers 17. In a preferred embodiment, the DC voltage is 12 VDC or 15 VDC. In another embodiment, the DC voltage could be multiple voltages.

It should be understood that the aforementioned embodiments are for exemplary purposes only and are merely illustrative of the many possible specific embodiments that can represent applications of the principles of the invention.

Without departing from the spirit and scope of this invention, one of ordinary skill in the art can make various changes and modifications to the invention to adapt it to various usages and conditions, including those not specifically laid out herein. As such, those changes and modifications are properly, equitable, and intended to be, within the full range of equivalents of the invention disclosed and described herein.

What is claimed is:

1. A wireless speaker kit for mounting to a ceiling fan having a fan unit housing a fan motor that rotates a plurality of fan blades, the fan unit having a bottom portion adapted to receive a fastener and electrical power wires, said wireless speaker kit comprising:

an audio housing adapted to be attached to the bottom portion of the fan unit to hangingly support said audio housing from the fan unit of the ceiling fan housing;

a light source mounted to said housing;

a wireless receiver and an amplifier disposed within said audio housing, said light source and said wireless receiver adapted for connection to said electrical power wires of said fan unit;

at least one speaker disposed in said housing and in communication with said wireless receiver;

a wireless transmitter for transmitting said audio signals to said wireless receiver; and a fastener for connecting the audio housing to the bottom of the fan unit.

2. The wireless speaker kit as in claim 1, wherein said audio housing includes a mounting bracket disposed at said upper end, said mounting bracket having an aperture, and wherein a fastener extends through said aperture to mount said audio housing to the bottom portion of the fan unit of the ceiling fan.

3. The wireless speaker kit as in claim 2, wherein said audio housing includes a domed shaped portion at a lower end of said audio housing, said at least one speaker disposed within said domed shaped portion.

4. The wireless speaker kit as in claim 3, wherein said at least one speaker is oriented within said domed shaped portion such that said audio signal is outputted in a direction opposite a gravitational direction.

5. The wireless speaker kit as in claim 4, wherein said audio housing includes a sound displacement element positioned between said mounting bracket and said at least one speaker.

6. The wireless speaker kit as in claim 5, wherein said sound displacement element includes an annular portion and a convex central portion extending towards said at least one speaker, said convex central portion position over a center of said at least one speaker.

7. The wireless speaker kit as in claim 6, wherein said annular portion is spaced apart from an upper end of said domed shaped portion.

8. The wireless speaker kit as in claim 7, wherein said sound displacement element directs said audio signal output from said at least one speaker in a radially direction through said space between said annular portion and said upper end of said dome shaped portion.

9. The wireless speaker kit as in claim 8, wherein said a plurality of posts extend between said annular portion and said upper end of said domed shaped portion.

10. The wireless speaker kit as in claim 9, wherein a sound permeable material covers said space between said annular portion of said sound displacement element and said upper end of said domed shaped portion.

11. The wireless speaker kit of claim 2 wherein the fastener has a width less than ½ inch.

12. The wireless speaker kit as in claim 1, wherein said at least one speaker include a mid-range speaker.

13. The wireless speaker kit as in claim 1, wherein said remote audio source generator is selected from the group consisting of a television, a stereo, an amplifier, a video game, a home theater system, a public address system, and a security system.

14. The wireless speaker kit as in claim 1, wherein said audio source is either stereophonic or monophonic.

15. The wireless speaker kit as in claim 1, wherein said transmitter includes RCA connectors and an audio input cord.

16. The wireless speaker kit as in claim 1, wherein said transmitter includes inputs for two audio source generators.

17. The wireless speaker kit as in claim 1, further comprising a light source disposed at a lower end of said domed shaped portion of said audio housing.

* * * * *